United States Patent [19]

Goettl

[11] 4,078,690

[45] Mar. 14, 1978

[54] PAN STRUCTURE

[76] Inventor: Adam D. Goettl, 4960 E. Palomino Rd., Phoenix, Ariz. 85018

[21] Appl. No.: 809,299

[22] Filed: Jun. 23, 1977

Related U.S. Application Data

[63] Continuation-in-part of Ser. No. 545,428, Jan. 30, 1975, Pat. No. 4,049,150.

[51] Int. Cl.[2] ..... B65D 7/42; B65D 5/24

[52] U.S. Cl. ..... 220/62; 229/31 R; 220/83; 220/75

[58] Field of Search ..... 220/1 R, 74, 75, 76, 220/83, 62, 63 R; 229/31 R, 31 FS

[56] References Cited

U.S. PATENT DOCUMENTS

| | | | |
|---|---|---|---|
| 927,537 | 7/1909 | Hothersall | 229/31 R |
| 1,933,857 | 11/1933 | Jones | 220/75 |
| 1,975,613 | 10/1934 | Nystrom et al. | 220/75 |
| 2,120,902 | 6/1938 | Moore | 229/31 R X |
| 4,049,150 | 9/1977 | Goettl | 220/62 |

*Primary Examiner*—George E. Lowrance
*Assistant Examiner*—Steven M. Pollard
*Attorney, Agent, or Firm*—Herbert E. Haynes, Jr.

[57] ABSTRACT

The top and sump pans of an evaporative cooler housing are formed of sheet metal and each have a planar surface with folded marginal flanges and are formed with diagonally folded corners that are structurally strong, leakproof and facilitate interconnection of the pans with interconnecting structural members.

11 Claims, 7 Drawing Figures

PAN STRUCTURE

CROSS-REFERENCE TO RELATED APPLICATION

This application is a continuation-in-part of pending prior application Ser. No. 545,428 filed Jan. 30, 1975, now U.S. Pat. No. 4,049,150, for: PAN STRUCTURE by the same inventor.

BACKGROUND OF THE INVENTION

1. Field of the Invention

This invention relates to evaporative coolers and more particularly to pan shaped structures and interconnecting structural elements therefor.

2. Description of the Prior Art

In the construction of evaporative cooler housings it is a common practice to form two separate pan shaped structures one for the top and one for the sump or bottom. The top and sump pans are then interconnected with corner posts, and in some instances, two of the corner posts are replaced with a sheet metal panel structure which extends between the pans and forms one side wall of the finished cooler housing. In either event, the interconnecting structural members are attached such as with screws, welding and the like, to the top and sump pans, and in the case of the corner post type of interconnecting structure, this attachment is limited to the corners of the top and sump pans.

Therefore, the manner in which the corners of the pans are formed is particularly improtant in that those corners must be structurally strong, should be easy to assemble into a finished evaporative cooler housing an must be leakproof. Furthermore, the corners of such pans should ideally not require any notching, punching, trimming or other special operations either during or after fabrication and such corners should be aesthetically appealing.

One particular prior art pan structure employed a drawn rounded corner configuration which, of course, was inherently leakproof but required a considerable amount of trimming after completion of the drawing operation. The equipment needed to fabricate such a rounded corner is very large and expensive and such a corner makes assembly of the housing difficult due to the problem of precisely locating and attaching a corner post or other pan interconnecting structure thereto.

Due to the difficulties associated with the above described rounded corner configuration, the most commonly employed corner structure is of square configuration.

In general, the prior art square corner configurations of the top and sump pans of evaporative cooler housings, and the techniques employed in fabricating such corners, have not satisfied the above described necessary and ideal characteristics due to a variety of factors. For example, some of the prior art square corner fabricating techniques require time consuming and costly special operations both during and after fabrication and result in corner configurations which are oftentimes unsightly, structurally weak, and must be rendered leakproof by the application of tar or other leakproofing substance. Further, some of these prior art square corner configurations are similar to the above described rounded corner in that special complex fixtures and excessive time is required to assemble the pan structures into a finished cooler housing.

Therefore, a need exists for a pan shaped structure having new and improved corner configurations and interconnecting structural elements for use in the construction of evaporative cooler housings and which solves some of the problems of the prior art.

SUMMARY OF THE INVENTION

In accordance with the present invention, new and improved pan structures with special square corner configurations and especially configured interconnecting elements which are particularly well suited for use in fabricating top and sump pans for evaporative cooler housings.

The pans are each fabricated from a single sheet of metal which is folded to provide a planar surface having marginal flanges which are normal to the planar surface, and which when folded form an integral partially folded corner tab at each corner of the pan. In other words, the end of adjacent ones of the marginal flanges form a corner junction which is normal to the planar surface and the partially folded corner tab is an extension of those adjacent marginal flanges and is common to both of those flanges.

Each of the partially folded corner tabs are collapsed diagonally toward the corner junction of their adjacent marginal flanges so that the plications of the fully collapsed corner tab will wrap around the corner and be in engagement with the end portions of both of the adjacent marginal flanges. Such collapsing of the corner tab will provide an angular flap portion thereof which extends beyond the limit of the adjacent marginal flanges.

Especially configured pan interconnecting elements such as side closing panels and corner posts are located to extend between the pans and are disposed normally with respect to the planar surfaces thereof. In the case of corner posts, each of the posts is an elongated angular sheet metal member which is slotted longitudinally at each of its ends. The slots provide a pair of spaced longitudinally extending angularly related flaps each of which is offset with respect to the main portion of the post for engaging the inwardly disposed surfaces of the marginal flanges with the main portion of the post in vertical alignment with the marginal flanges. The side closing panel is similarly configured at its opposite sides for connection to the corners of the pans.

The extending angular flap formed by the folded corner tab is offset with respect to the main portion of the corner tab for engaging the main portion of the corner post or the side closing panel.

The flaps of the interconnecting elements are affixed to the marginal flanges of the pan such as by spot welding and the main portions of the elements are affixed to the extending angular flap of the folded corner tab in the same fashion.

In this manner, the pan structure is fabricated with a minimum number of fabrication operations and is inherently leakproof and of exceptional structural strength. Furthermore, the interconnecting elements are simple to fabricate and affix to the pan structure with the end result being an aesthetically appealing assembly which is easy and inexpensive to manufacture.

Accordingly, it is an object of the present invention to provide a new and useful pan structure with at least one normally extending structural member affixed thereto.

Another object of the present invention is to provide a new and useful pan structure having at least one normally extending structural member rigidly affixed thereto which is simple and inexpensive to manufacture and is leakproof and of exceptional structural strength.

Another object of the present invention is to provide a new and useful pan structure with integral diagonally and angularly folded corners and having at least one structural member rigidly affixed to at least one of the folded corners of the pan structure and extending normally therefrom.

Still another object of the present invention is to provide a pan structure of the above described character which is ideally suited for use as the top and sump pans of an evaporative cooler with the special corners of the pans being interconnected by rigidly affixed interconnecting elements of special construction.

The foregoing and other objects of the present invention, as well as the invention itself, may be more fully understood from the following description when read in conjunction with the accompanying drawings.

DESCRIPTION OF THE PREFERRED EMBODIMENTS

Figure 1:
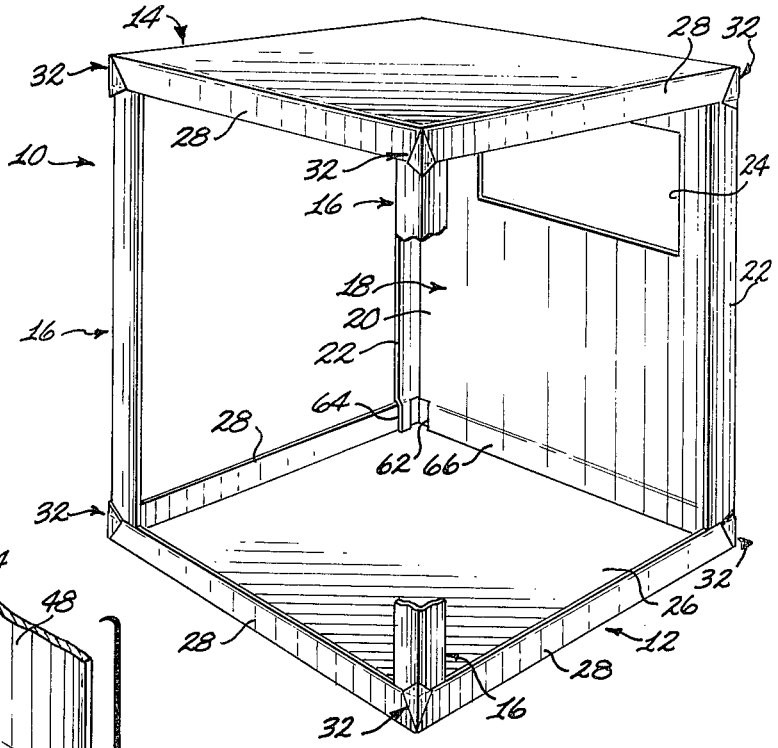
FIG. 1 is a perspective view of one type of evaporative cooler housing which is fabricated in accordance with the present invention.

Referring more particularly to the drawings, FIG. 1 illustrates an evaporative cooler housing which is indicated generally by the reference numeral 10. The cooler housing 10 is of the type employed in the fabrication of an evaporative cooler assembly known in the industry as a "side draft" cooler as will hereinafter be described in detail.

The housing 10 is fabricated with an upwardly opening sump pan 12 and an identical inverted top pan 14 which are spaced apart and interconnected with pan interconnecting elements or structures which in this particular type of housing 10 includes a pair of corner posts 16 and a sideclosing panel 18.

Each of the corner posts 16 is an elongated element which is angular in transverse cross section and is especially configured at each of its opposite ends for rigid affixation between aligned corners of the sump pan 12 and top pan 14 of the housing 10 as hereinafter will be described in detail.

The side closing panel 18 is fabricated of sheet metal and is formed to have a planar surface 20 with a side flange 22 formed on each of the opposite vertical sides of the planar surface 20. The flanges 22 are each normal to the planar surface 20 so as to provide an angular in cross sectional relationship at each of the opposite vertical sides of the panel, with that relationship being the same as the angular configuration of the corner posts 16. The panel 18 is especially configured at each of its corners for rigid affixation between aligned pairs of the corners of the sump pan 12 and top pan 14 in a manner similar to affixation of the corner posts 16.

The housing fabricated as described above includes an interior area which is employed, as is customary, to house the conventional elements of an evaporative cooler such as a centrifugal blower (not shown), drive mechanism (not shown) and a water distribution system (not shown). The particular housing 10 is configured to have one closed and three open sides, with the open sides being employed for demountably retaining the usual evaporative cooler pads (not shown). The panel 18 which closes the remaining side of the housing 10 is formed with an opening 24 therethrough which serves as the outlet from the centrifugal blower (not shown). The physical location of the outlet opening 24 in the side of the housing 10 is what determines that the housing is of the "side draft" type.

Another type of cooler housing (not shown) is known in the industry as a "down draft" cooler in that its centrifugal outlet is provided through the sump pan. In that particular type of evaporative cooler, the pan interconnecting elements would be in the shape of the previously described corner posts 16 with an additional pair of such posts replacing the side closing panel 18. Thus, it may now be seen that various combinations of pan interconnecting structures may be employed in the fabrication of evaporative cooler housings.

As hereinbefore mentioned, the opposite ends of the corner posts 16 and each of the corners of the closing panel 18 are especially configured. This special configuration, which will be hereinafter described in detail, is accomplished so that these pan interconnecting elements may be rigidly affixed, in a simple manner, between the sump pan 12 and top pan 14.

Since the sump pan 12 and the top pan 14 are identical, it should be understood that the following description of the sump pan 12 also applies to the top pan 14.

The sump pan 12 is formed of a single flat blank of sheet metal which is folded to provide a flat planar surface 26 having marginal flanges 28 extending normally therefrom. Such folding, as seen best in FIG. 2 will move the adjacent ends of adjacent ones of the marginal flanges 28 into abutting engagement with each other to form a corner junction 30, (one shown in FIG. 2) at each corner of the sump pan 12. That same folding operation also forms a corner tab 32 at each of the corner junctions 30. Since the sump pan 12 is formed from a single flat blank, it will be seen that the corner tabs 32 are integral with the planar surface 26 and with the marginal flanges 28.

Figure 2:
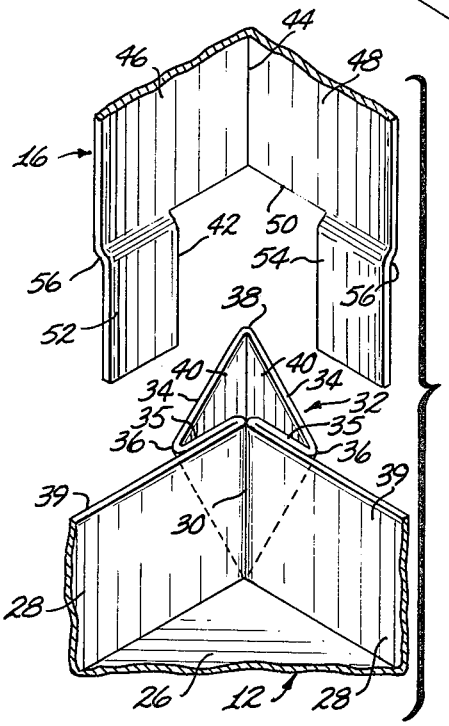
FIG. 2 is an enlarged exploded fragmentary isometric view of a typical corner of the pan shaped structure employed in formation of the evaporative cooler housing, with that corner having the pan interconnecting element ready for attachment thereto.
Figure 3:
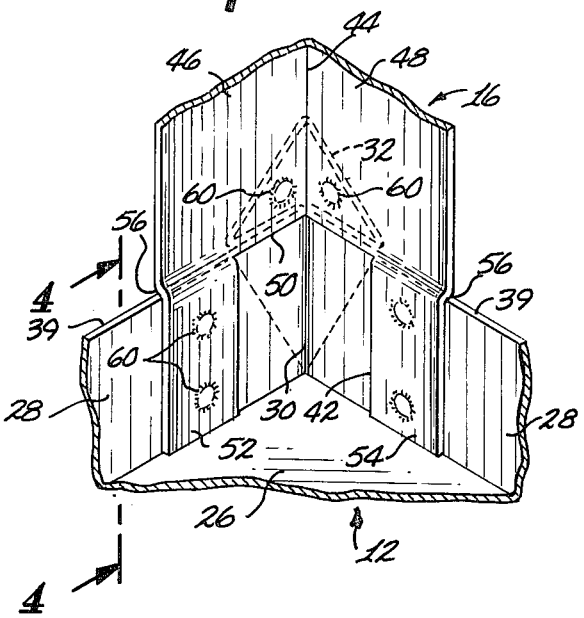
FIG. 3 is a fragmentary isometric view similar to FIG. 2 and having the pan interconnecting element affixed thereto.
Figure 4:
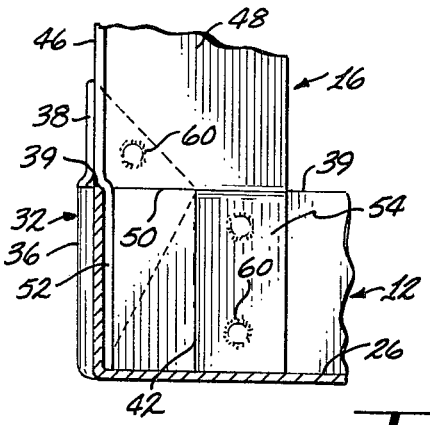
FIG. 4 is a sectional view taken along the line 4—4 of FIG. 3.

The above described folding operation will position the corner tabs 32 formed thereby in an outwardly disposed partially folded position (not shown), and the formation of the sump pan 12 is completed by diagonally folding the corner tabs 32 into engagement with their respective corner junctions 30, and angularly folding the corner tabs 32 into engagement with the adjacent marginal flanges 28 of the corner junctions. The diagonal and angular folding of the corner tabs 32 forms those tabs into angularly related lateral portions or plications 34 each of which includes an inner segment 35 and an outer segment 36, with the inner segment 35 folded back onto the marginal flange 28 and the outer segment 36 folded back onto the inner segment 35, as best seen in FIG. 2.

As a result of the above described folding operations, each of the corner tabs 32 also include a flap portion 38 which extends beyond the extending edges 39 of the marginal flanges 28 with the flap portion 38 being folded to form a pair of flap segments 40 which have the same angular relationship to each other as the marginal flanges 28 have with respect to each other. Further, the flap portion 38 is inwardly offset an amount equal to the metal thickness of which the pan 12 is formed as will hereinafter be described.

As hereinbefore mentioned, the pan interconnecting structural members in the form of corner posts 16 are elongated structures which are angular in cross section and which are expecially configured at their opposite ends. As best seen in FIG. 2, wherein a typical end of one of the corner posts 16 is shown, the special configuration includes a slot 42 which extends from the end of the post a short distance longitudinally along the junction 44 of the angularly related surfaces 46 and 48, and terminates at a transverse angular edge 50. Formation of the slot 42 in the end of the post 16 provides a spaced pair of angularly disposed flap members 52 and 54, with the flap 52 being an extension of surface 46 and flap 54 being an extension of surface 48. Each of the flaps 52 and 54 are inwardly offset an amount approximately equal to the thickness of the sheet metal of which the pan structures 12 and 14 are formed. In this manner, the angularly related surfaces 46 and 48 of the post 16 are each formed with a ledge 56 at the juncture of the flaps 52 and 54 with their respective surfaces, and those ledges 56 are in alignment with the transverse angular edge 50 formed by the slot 42. The slot 42 is sized as to its length so that the flaps 52 and 54 have a length dimension which is approximately equal to the width dimension of the marginal flanges 28 of the sump pan 12, and is sized as to its width dimension so that the angular edge 50 is approximately equal in length to the maximum width dimension of the folded corner tab 32 of the sump pan 12.

Thus, the closing panel 18 will be seen to be assembled and affixed to the sump pan 12 and top pan 14 in the same manner as the corner posts 16 are attached thereto.

Figure 5:
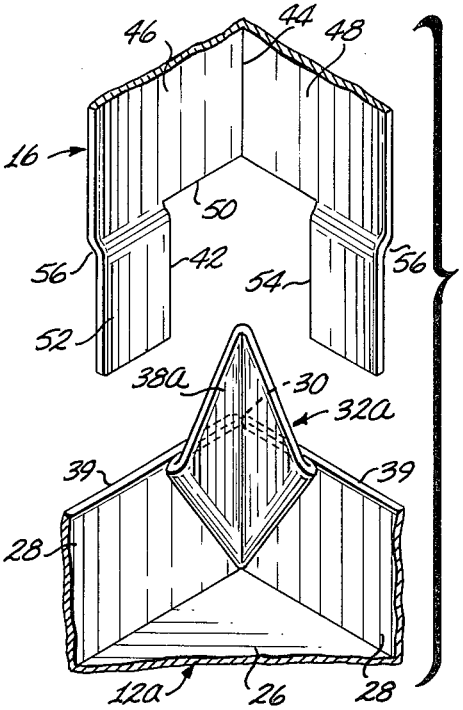
FIG. 5 is an exploded fragmentary isometric view similar to FIG. 2 and illustrating a modification of the structure of the present invention.
Figure 6:
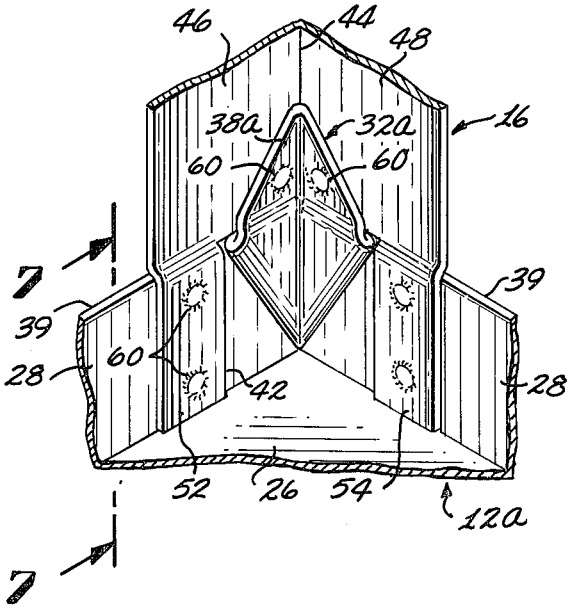
FIG. 6 is a fragmentary isometric view similar to FIG. 5 and having the pan interconnecting element affixed thereto.
Figure 7:
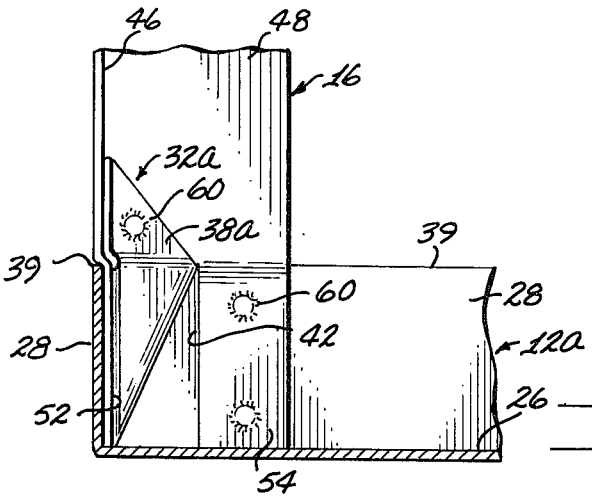
FIG. 7 is a sectional view taken along the line 7—7 of FIG. 6.

Reference is now made to FIGS. 5, 6 and 7 wherein a modification of the structure of the present invention is illustrated. In this embodiment, the sump and top pans are fabricated in a different manner with regard to the corners thereof, and FIG. 5 best shows a typical corner of the sump pan 12a. During fabrication of the sump pan 12a, the corner tabs 32a are deflected inwardly during folding of the marginal flanges 28. The inwardly partially folded corner tabs 32a (not shown) are then diagonally and angularly folded into engagement with the corner junction 30 and the inner surfaces of the marginal flanges 28 which form that junction. Such folding, as before, provides an angular flap portion 38a which extends beyond the free or extending edges 39 of the marginal flanges 28, with that angular flap portion 38a being outwardly offset an amount equal to the metal thickness of which the sump pan 12 is formed.

The pan interconnecting structural members 16 and 18, with the corner post 16 being shown, are formed in the same manner as hereinbefore described. Assembly of the corner post 16 to the sump pan 12a is similar to the assembly thereof to the pan 12 with the difference being that the inwardly disposed offset flap portion 38a of the tab 32a of this embodiment is in contiguous engagement with the inner surfaces of the angularly related surfaces 46 and 48 of the corner post 16.

Rigid affixation of the corner post 16 to the sump pan 12a is accomplished preferably by spot welds 60 in the same manner as the previously described affixation of the post 16 to the sump pan 12.

While the principles of the invention have now been made clear in an illustrated embodiment, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. A pan shaped structure having at least one structural member attached thereto comprising:

a. a planar surface the periphery of which is defined by a plurality of angularly related edges;

b. a marginal flange at each edge of said planar surface, said marginal flanges extending normally from said planar surface with extending edges and disposed to form an angular corner junction between each adjacent pair of said marginal flanges;

c. a plurality of corner tabs unitary with said planar surface and with said marginal flanges with a different one of said corner tabs at each of the angular corner junctions, each of said corner tabs folded diagonally into engagement with its respective one of the corner junctions and angularly into engagement with the pair of said marginal flanges which form that corner junction, each of said corner tabs having an angular flap portion extending beyond its respective one of the corner junctions;

d. at least one corner post having an angular transverse cross section, said corner post normal to said planar surface and having one of its ends adjacent one of said corner junctions, said end having a slot formed therein longitudinally of said post to provide a pair of angularly related flaps which engage said pair of marginal flanges at locations set back from the corner junction formed thereby, said corner post in engagement with the angular flap portion of the one of said corner tabs to which it is adjacent; and e. means for fixedly attaching said pair of flaps to the engaged marginal flanges and for attaching said corner post to the engaged angular flap portion of said corner tab.

2. A pan shaped structure as claimed in claim 1 wherein said corner tabs are disposed to engage the outwardly facing surfaces of said marginal flanges.

3. A pan shaped structure as claimed in claim 1 wherein said corner tabs are disposed to engage the inwardly facing surfaces of said marginal flanges.

4. A pan shaped structure as claimed in claim 1 wherein the slot formed in said corner post terminates in an angular edge transverse to the length of said corner post and said pair of angularly related flaps of said corner post are offset from the main portion thereof an amount equal to the thickness of said marginal flanges whereby said angular edge is located on the extending edges of said marginal flanges adjacent the corner junction formed thereby.

5. A pan shaped structure as claimed in claim 1 wherein the slot formed in said corner post has a width dimension which is at least as large as the width dimension of said corner tabs.

6. A pan structure as claimed in claim 1 wherein the angular flap portion of said corner tab is offset from the main portion thereof for engaging said corner post.

7. A pan shaped structure as claimed in claim 1 wherein:

a. the slot formed in said corner post terminates in an angular edge transverse to the length of said corner post;

b. said pair of angularly related flaps of said corner post are offset from the main portion thereof an amount substantially equal to the thickness of said marginal flange to form a ledge between each of said flaps and the main portion of said corner post, said ledges aligned with said angular edge; and c. said ledges and said angular edge being positioned on the extending edges of said marginal flanges adjacent the angular corner junction formed thereby.

8. A pan shaped structure having at least one structural member attached thereto comprising:

a. a planar surface the periphery of which is defined by a plurality of angularly related edges;

b. a marginal flange at each edge of said planar surface and extending normally from said planar surface, said marginal flanges having extending edges and forming an angular corner junction between each adjacent pair of said marginal flanges;

c. a plurality of corner tabs unitary with said planar surface and with said marginal flanges with a different one of said corner tabs at each of said corner junctions, each of said corner tabs folded diagonally into engagement with its respective one of said corner junctions and angularly into engagement with ones of said marginal flanges which form that corner junction, each of said corner tabs having an angular flap portion extending beyond its respective one of said corner junctions;

d. a panel member extending normally from said planar surface and having at least one side flange which extends therefrom at an angle substantially equal to the angular relationship of said corner junctions, said panel having a slot therein which extends from one edge thereof along the junction between said panel and said side flange to provide a pair of angularly related extending flaps for engaging an adjacent pair of said marginal flanges at locations set back from the corner junction formed thereby, said panel in engagement with the angular flap portion of the one of said corner tabs located at the corner junction; and e. means for fixedly attaching said pair of flaps to their respectively engaged ones of said pair of marginal flanges and for attaching said panel to the engaged flap portion of said corner tab.

9. A pan shaped structure as claimed in claim 8 wherein said corner tabs are folded to engage the outwardly facing surfaces of said marginal flanges.

10. A pan shaped structure as claimed in claim 8 wherein said corner tabs are folded to engage the inwardly facing surfaces of said marginal flanges.

11. A pan shaped structure as claimed in claim 8 wherein:

a. the slot formed in said panel member terminates in an angular edge;

b. said pair of angularly related flaps of said panel and said side flange being offset from the main portions thereof an amount substantially equal to the thickness of said marginal flanges to form a ledge between said panel and its respective one of said flaps and another ledge between said side flange and its respective one of said flaps, said ledges aligned with said angular edge; and c. said ledges and said angular edge being positioned on the extending edges of said marginal flanges adjacent the corner junction formed thereby.

* * * * *